US010458114B2

(12) United States Patent
Lestini et al.

(10) Patent No.: US 10,458,114 B2
(45) Date of Patent: Oct. 29, 2019

(54) MODULAR BUILDING STRUCTURE

(71) Applicant: EMMEALLAENNE S.R.L., Rome (IT)

(72) Inventors: Federico Lestini, Rome (IT); Luca Pofi, Rome (IT)

(73) Assignee: EMMEALLAENNE S.R.L., Rome (IT)

( * ) Notice: Subject to any disclaimer, the term of this patent is extended or adjusted under 35 U.S.C. 154(b) by 0 days.

(21) Appl. No.: 16/068,777

(22) PCT Filed: Dec. 23, 2016

(86) PCT No.: PCT/IB2016/057968
§ 371 (c)(1),
(2) Date: Jul. 9, 2018

(87) PCT Pub. No.: WO2017/122070
PCT Pub. Date: Jul. 20, 2017

(65) Prior Publication Data

US 2019/0024364 A1 Jan. 24, 2019

(30) Foreign Application Priority Data

Jan. 13, 2016 (IT) ..... 102016000002424

(51) Int. Cl.
*E04B 1/19* (2006.01)
*E04B 1/348* (2006.01)
(Continued)

(52) U.S. Cl.
CPC ..... *E04B 1/1912* (2013.01); *E04B 1/3483* (2013.01); *E04H 1/005* (2013.01);
(Continued)

(58) Field of Classification Search
CPC ..... E04B 1/1903; E04B 1/1912; E04B 2001/1957
See application file for complete search history.

(56) References Cited

U.S. PATENT DOCUMENTS 2,868,568 A * 1/1959 Frye ..... A63H 33/06 403/171
3,399,914 A * 9/1968 Grant ..... E04B 1/1903 261/DIG. 72
(Continued)

FOREIGN PATENT DOCUMENTS

EP 0389214 A2 9/1990
FR 2675527 A 10/1992
(Continued)

*Primary Examiner* — Andrew J Triggs
(74) *Attorney, Agent, or Firm* — Volpe and Koenig, P.C.

(57) ABSTRACT

A modular building structure, obtained by assembling a plurality of module frames to obtain a complex frame is provided. The structure includes walls and floors implemented by cladding panels, and the module frames have a substantially parallelepiped shape. The structure includes connecting knots joining module frames adjacent on a same plane, on the lower side or upper side, at angles, or which provides for the connection of the module frames to a basement or to a roof structure. Each knot has a box-like structure with an inner core shaped like a hollow straight parallelepiped, formed by six walls facing two by two, each wall has an opening that form respective channels opened according to orthogonal axes. At each opening, the knot includes a corresponding supporting plate, parallel or orthogonal therebetween; each supporting plate, extending beyond the plane defined by one or more adjacent supporting plates, defines a respective rest.

13 Claims, 6 Drawing Sheets

(51) Int. Cl.
*E04H 1/00* (2006.01)
*E04H 1/04* (2006.01)
*E04F 17/08* (2006.01)

(52) U.S. Cl.
CPC ..... *E04H 1/04* (2013.01); *E04B 2001/1957* (2013.01); *E04F 17/08* (2013.01)

(56) References Cited

U.S. PATENT DOCUMENTS 4,065,220 A * 12/1977 Ruga ..... E04B 1/1903 403/169
4,406,562 A * 9/1983 Nasi ..... E04B 1/19 403/347
4,449,843 A * 5/1984 Wendel ..... E04B 1/1903 403/173
4,551,960 A * 11/1985 Fleishman ..... E04B 1/1903 403/172
4,780,018 A * 10/1988 Godden ..... E04B 1/1906 403/173
4,904,108 A * 2/1990 Wendel ..... E04B 1/1912 403/170
4,905,443 A * 3/1990 Sutcliffe ..... E04B 1/1906 403/171
5,816,011 A * 10/1998 Kuramoto ..... B65D 90/0006 52/655.1
9,115,504 B2 8/2015 Wallance
2004/0103596 A1 6/2004 Don et al.
2009/0307944 A1 12/2009 Buckbee
2011/0011018 A1 1/2011 Johnson et al.
2011/0047889 A1 3/2011 Gad et al.
2013/0305629 A1 11/2013 Stephenson et al.
2015/0152634 A1 6/2015 Unger

FOREIGN PATENT DOCUMENTS

GB 2447289 A 9/2008
GB 2451092 A 1/2009
JP H09 328818 A 12/1997
JP 2009209551 A 9/2009
JP 2009228369 A 10/2009
KR 101363739 B1 2/2014
WO 2014176710 A1 11/2014
WO 2015115990 A1 8/2015

* cited by examiner

MODULAR BUILDING STRUCTURE

The present invention relates to a modular building structure, of the type obtained by assembling a plurality of module frames to obtain a complex frame, and comprising walls and floors implemented by suitable cladding panels.

In particular, in the present invention the above-mentioned module frames have a substantially parallelepiped-like shape, being suitable to be transported as usual containers with standard sizes, without requesting the use of special transportation devices, complete with panels and pre-assembled accessories. The module frames are identified by longitudinal, vertical and transversal beams which join at respective angles.

French patent N. FR 2,675,527 A relates to a prefabricated housing which can be transported, wherein a series of environments, obtained by walls equipped with preformed openings, can be assembled by exploiting the hexagonal plan of the several architectural elements: the assembling takes place by bolting therebetween the single walls which can be made of wood.

British patent N. GB 2,447,289 A relates to a system for assembling therebetween housing modules substantially constituted by containers. The system is constituted by connector elements to be fastened to respective containers and to through plugs which interconnect the connector elements: the latter, once assembled, keep the containers at a prefixed distance therebetween and show openings; they can be equipped with simple, T-like or double T-like beams joining the connector elements assembled on two axes.

British patent N. GB 2,451,092 A relates to a unit structure of prefabricated modules which substantially have the shape of a container, like a parallelepiped; on respective long edges each module has beams with particular shape which couple to the corresponding beams of adjacent modules, and these beams incorporate systems for the quick fastening of mechanical type, for example velcro, but even sliding tracks to allow the modules to slide one onto the other one in order to couple quickly said fastening systems.

U.S. Pat. No. 8,701,371 B describes a method for implementing multi-layered buildings by using prefabricated elements, providing the concrete casting which follows the positioning of a structure constituted by bearing walls and beams, and subsequently the positioning of claddings.

U.S. Pat. No. 9,115,504 B2 describes a method for assembling housing modules shaped like containers to obtain complex architectures, with particular mechanical assembling between the modules.

US patent application N. US 2015/152,634 A describes another method for assembling housing modules to obtain a complex building, wherein the single modules have a base constituted by a series of C-like beams constituting a spacing element with the underneath module or with the base foundation.

US patent application N. US 2004/103,596 A, instead, describes another modular system wherein the floor of each module comprises a rectangular frame and a plurality of transversal beams.

Other examples of complex modular structure are described in US patent applications N. US 2009/307,994 A, N. US 2011/011,018 A, N. US 2011/047,889 A, N. US 2013/305,629 and in International patent applications N. WO 2014/176,710 A1 and N. 2015/115,990.

Japanese patent application JP H09 328,818 A describes a modular structure of buildings constructed by means of modular frames, with cladding panels for walls and floors, wherein the modular frames have a shape like a parallelepiped with transversal, longitudinal and vertical beams connected to the respective angles, the latter formed by a knot.

Other structure examples are described in Japanese patent applications N. JP 2009 209,551 A and N. JP 2009 228,369 A, in South Korea patent N. KR 101 363 739 B1 and in European patent application N. EP 0,389,214 A2.

However, the examples of the above-mentioned modular structures may require, according to cases, the assembling of a complex frame thereto subsequently all other portions of the building have to be added: walls, stairs, floor plants and so on, by filling-in the previously constructed frame with a work which requires a massive use of specialized manpower and time, or the assembling of preconstructed modules, the functions thereof diverge from those requested in a usual construction work, by making such structures suitable only to uses of provisional type.

Moreover, in the second mentioned case the preconstructed modules have sizes that make difficult their transportation, which in turn requires the use of special means with the related difficulties, except when the needs to be fulfilled with the final assembling of the building are very reduced and they can be solved by simply overlapping box-like structures one onto the other one.

The technical problem underlying the present invention is to provide a modular building structure allowing to obviate the drawback mentioned with reference to the known art.

The solution idea consists in taking the best aspects of the above-described two types of assembled buildings, by uniting them in a single solution with modules to be transported easily as falling within the sizes of the standard containers, which can be loaded on normal transportation means.

Such problem is solved by a building structure as above described characterizing in that it comprises a plurality of connecting knots joining module frames adjacent on a same plane, on the lower side or upper side, at said angles, or which provides for the connection of the module frames to a flat basement or to a roof structure, wherein each knot has a box-like structure with an inner core shaped like a hollow straight parallelepiped, formed by six walls facing two by two, wherein each wall has an opening so that the openings form respective channels opened according to orthogonal axes, and wherein, at each opening, the knot comprises a corresponding supporting plate, the plates being parallel or orthogonal therebetween two by two; each supporting plate, extending beyond the plane defined by one or more adjacent supporting plates, defines a respective rest.

The main advantage of the building structure according to the present invention lies in the fact of allowing an easy assembling of modules equipped with finishings, so as to leave a free space which can be exploited in order to place technical plants and the like.

The present invention will be described hereinafter according to a preferred embodiment example thereof, provided by way of example and not for limitative purposes with reference to the enclosed drawings wherein.

By referring to the figures, a complex frame of a modular building structure is designated with 1; it is constituted by a certain number of module frames which have a substantially parallelepiped-like shape and are identified by the longitudinal beams 2, the vertical beams 3 and the transversal beams 4.

Under parallelepiped, generally a straight parallelepiped with rectangular faces is meant.

Figure 7:
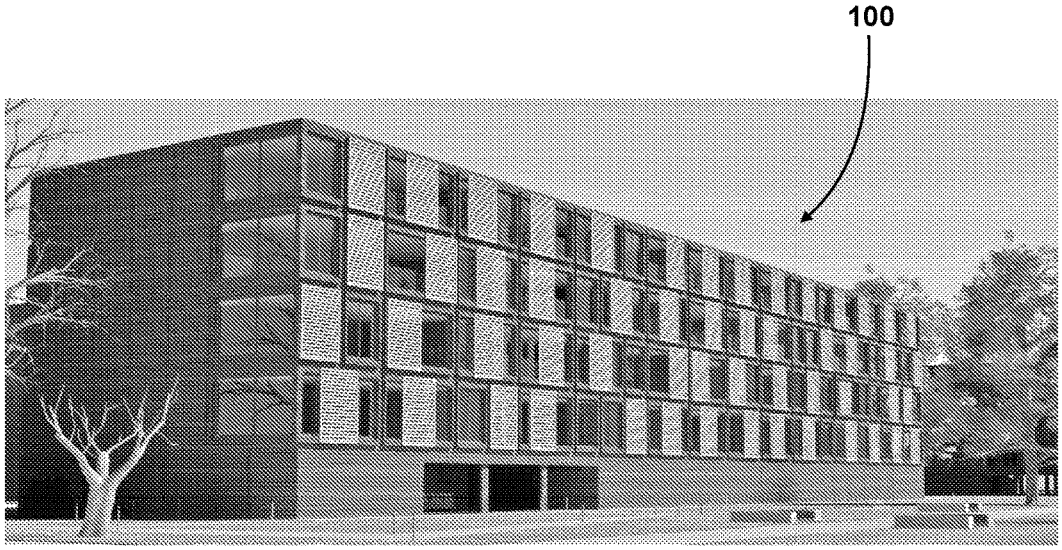
FIGS. 7 and 8 show views of complex buildings which can be obtained with the structure according to the present invention.
Figure 8:
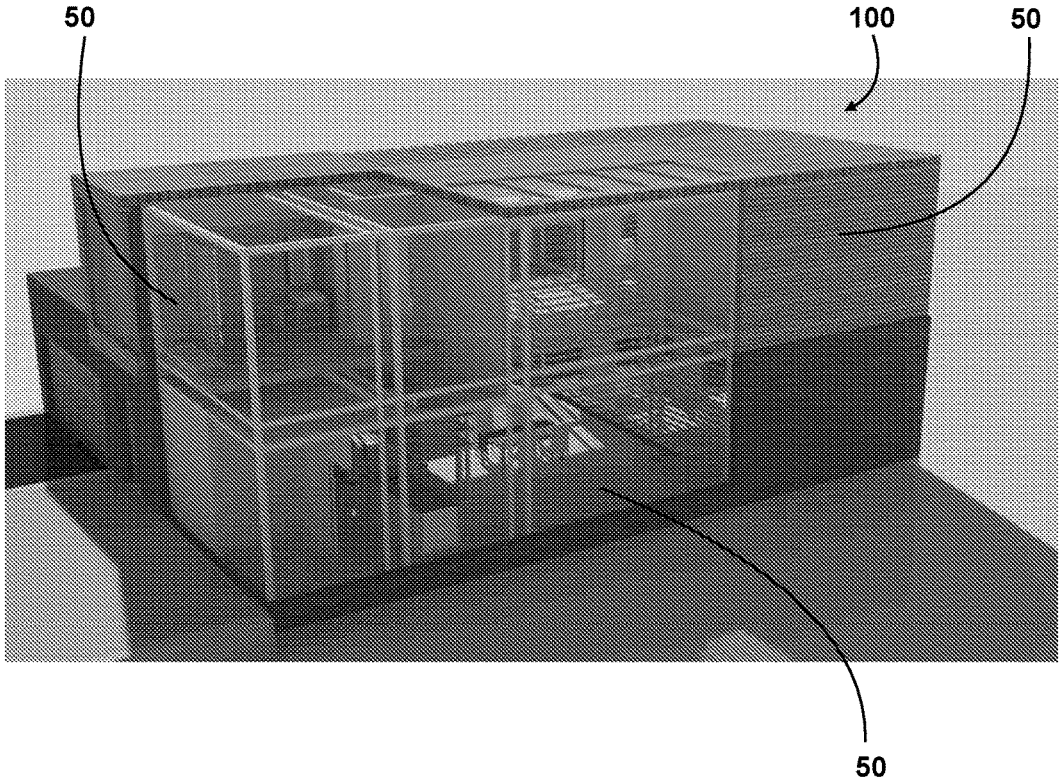

In the described version, each module frame, designated with 10, has sizes allowing it to fall within the shape of a container which can be transported by ordinary route, in case loaded on the platform of an articulated vehicle, without requiring a special transportation to move it from the assembly site to the production site. A building module 50 then will correspond to each module frame, the building module comprising the related claddings, the floors (ceiling, floor), the inner structure, the electric and water services and so on and it could be useful to assemble a complex building 100 (FIGS. 7 and 8) with different sizes.

Each module frame 10 then has angles wherein the longitudinal, vertical and transversal beams join. At such angles, the complex frame 1 comprises a plurality of connecting knots 5 joining module frames 10 adjacent laterally on the same horizontal or vertical plane, the lower side or upper side on staggered planes, or providing for the connection of the module frames 10 to a suitably arranged flat basement, or to a not represented roof structure.

In case of adjacent module frames 10, they could be faced at a longitudinal, vertical, upper or lower wall; otherwise, in case of frames on staggered planes, they will have in common an edge with two beams of the same type faced one onto the other one.

Therefore, the shapes of each knot 5 change according to the knot position, in particular each knot 5 should be capable of providing for the mutual connection of a number of module frame varying from one to eight and thereof with basement.

However, each knot has features common to all shapes which identify it, and which will be detailed hereinafter.

In particular, the knot 5 has a box-like structure with an inner core 6 shaped like a hollow straight parallelepiped, formed by six walls facing two by two. Each wall has a circular opening 7, delimited by a ring 8.

Preferably the core 6 has cubic shape. The openings 7 on the faces thereof form respective channels opened according to orthogonal axes X, Y and Z. Such channels are opened, and the core inner portion provides a space for passing through a channel or from a channel to the other one.

The core could be made of a suitable material, for example steel, preferably in one single piece and with adequate thicknesses, so as to have the required resistance to any design stress.

At each opening 7, the core 6 comprises a corresponding supporting plate 9, for a total of six supporting plates, parallel or orthogonal therebetween two by two; in particular, the plates 9 of openings 7 one in front of the other one are parallel therebetween, and the plates 9 of openings 7 on adjacent plates are orthogonal therebetween.

Even the supporting plates could be made of suitable material, in case in one single piece with the core 6, or by means of welding of pieces.

Each supporting plate 9, if it extends beyond the plane defined by an adjacent plate 9, defines therewith an angular or side rest for a module frame angle 10.

Figure 1:
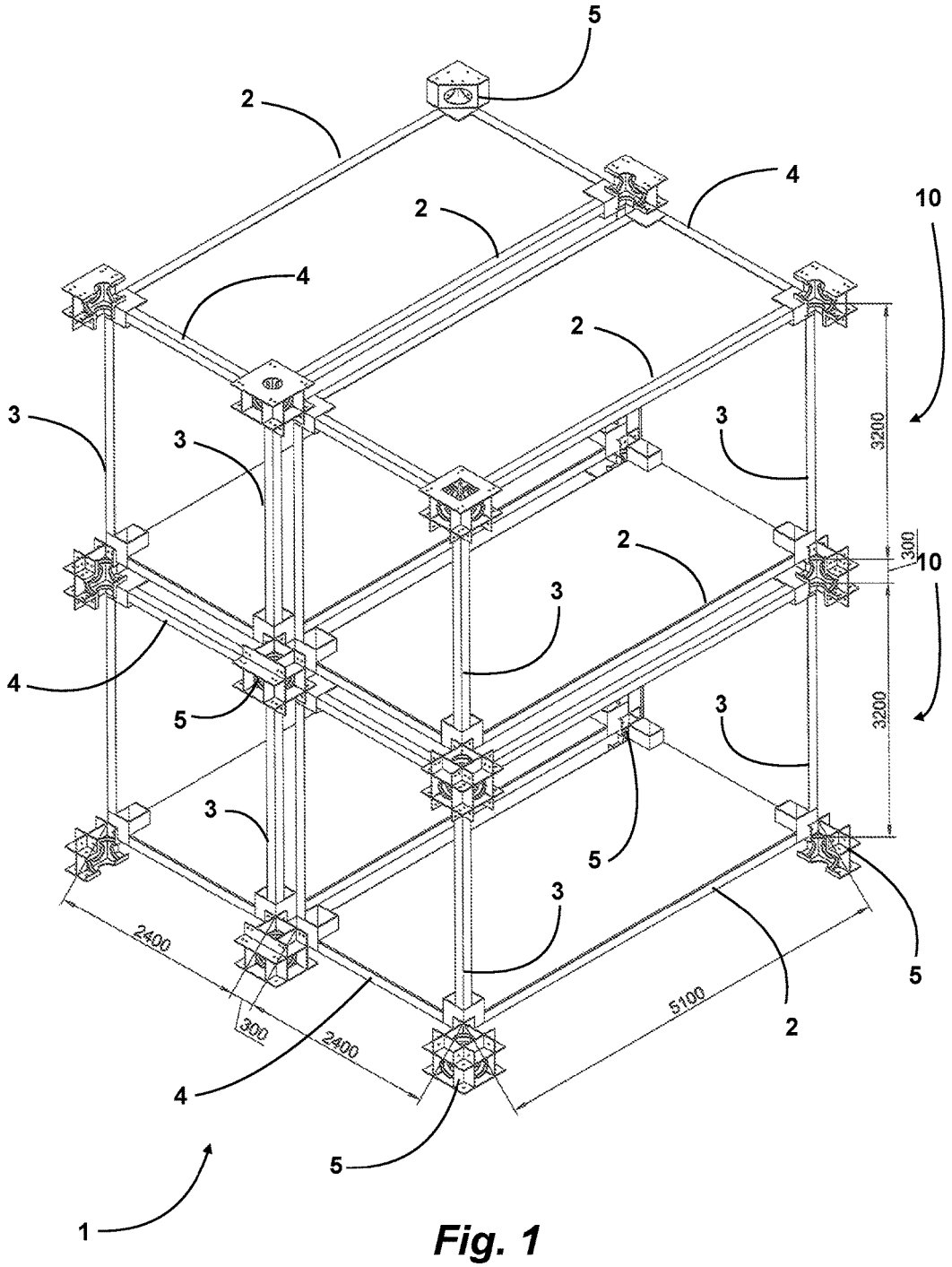
FIG. 1 shows an axonometric view of a complex frame resulting from assembling several module frames of the structure according to the present invention, wherein the mentioned dimensions represent purely indicative and not limiting values.
Figure 2:
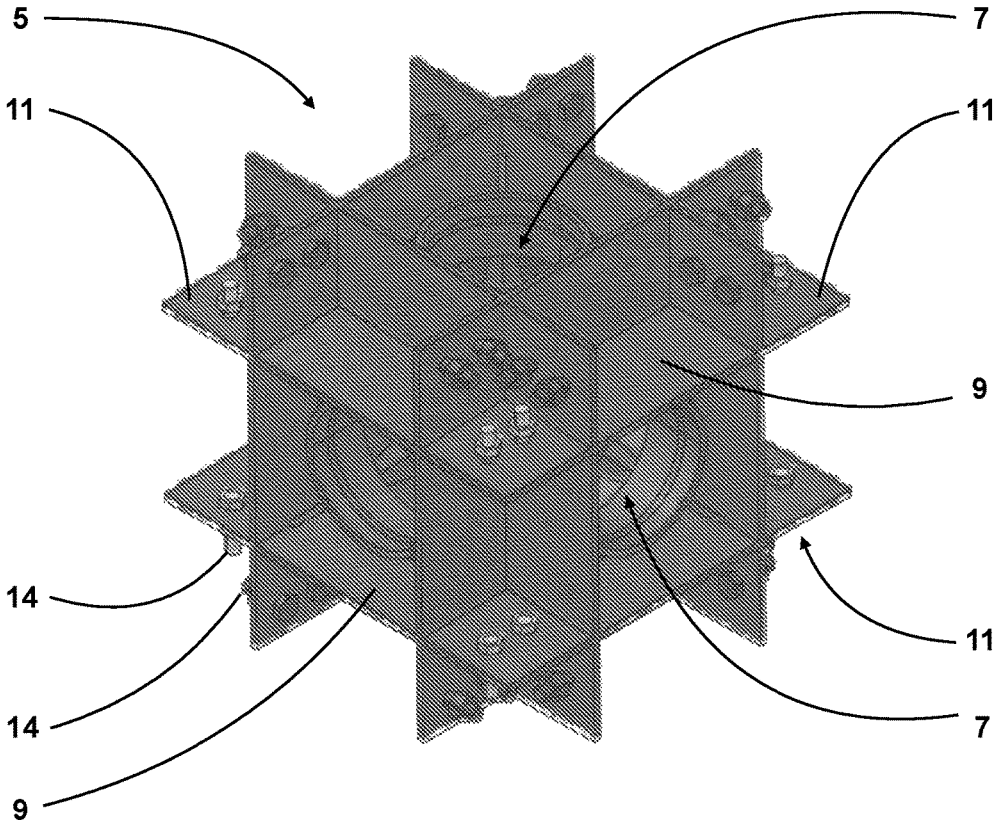
FIG. 2 shows an axonometric view of an assembling knot for the connection of the module frames.
Figure 2A:
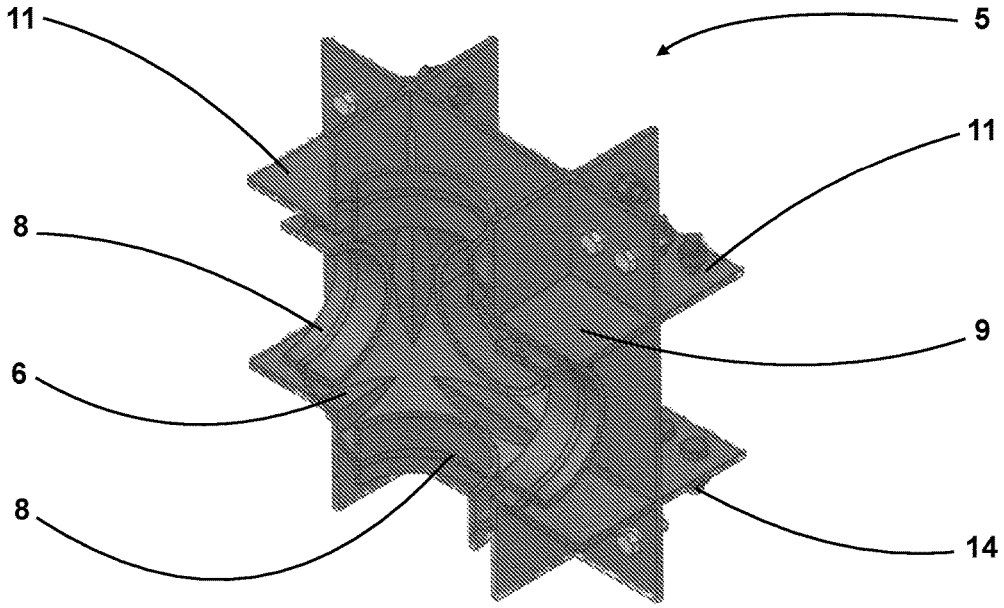
FIG. 2A shows the sectioned previous view.
Figure 3:
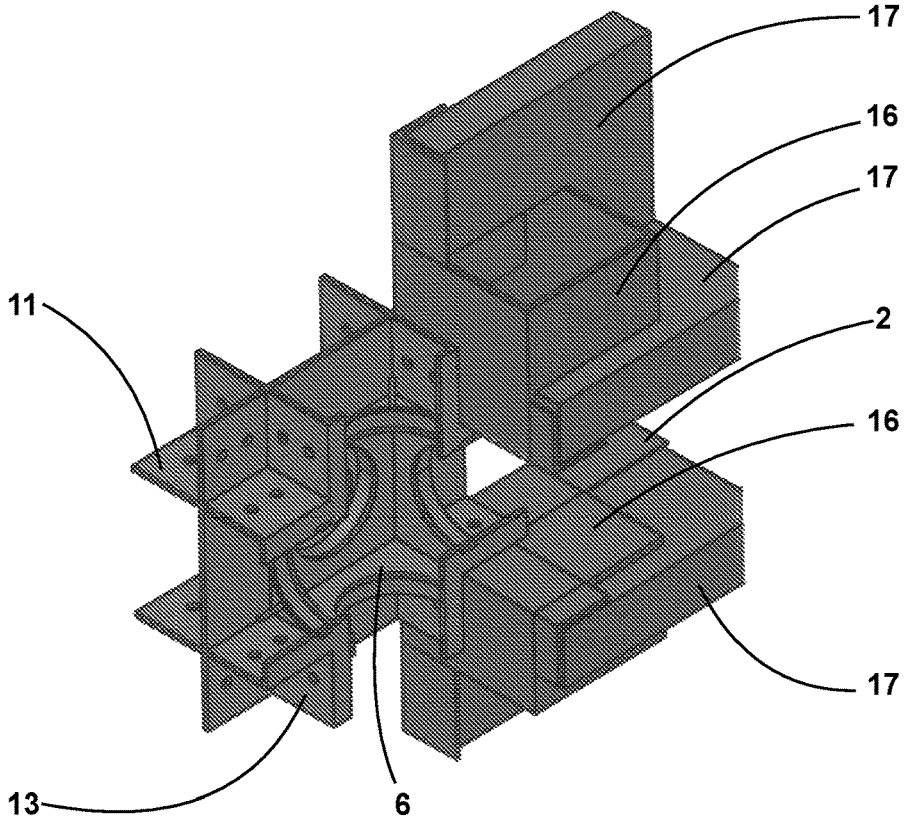
FIGS. 3, 4, 5 and 6 show axonometric views in partial section illustrating in detail different assembling shapes at a knot of the complex frame in the structure according to the present invention.

By referring to FIG. 2, on each angle of the core 6 the plates 9 extend beyond the two adjacent plates and viceversa, and then, at each one of said angles, the knot has an angular rest 11 formed by three supporting plates 9 forming an angular space with the three resting walls.

Figure 4:
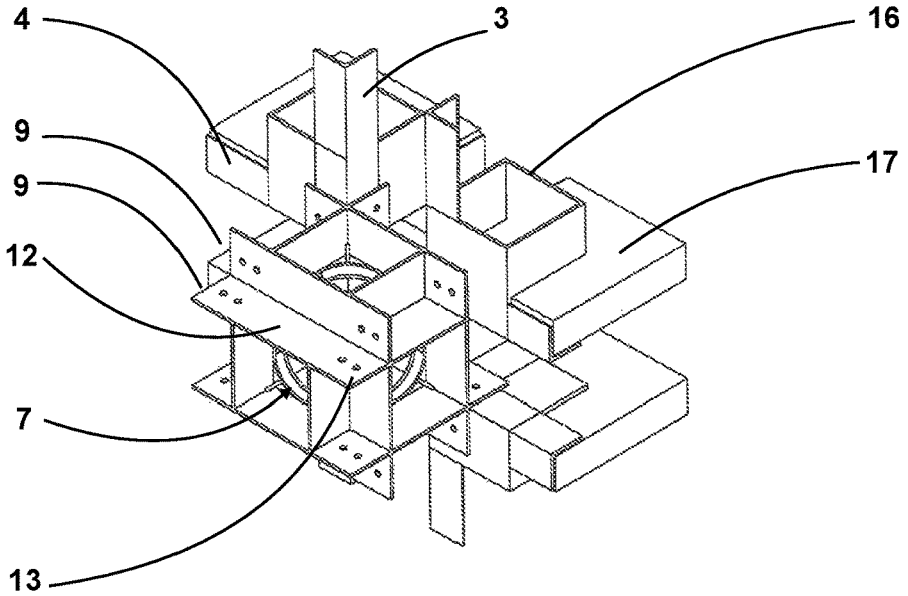
Figure 5:
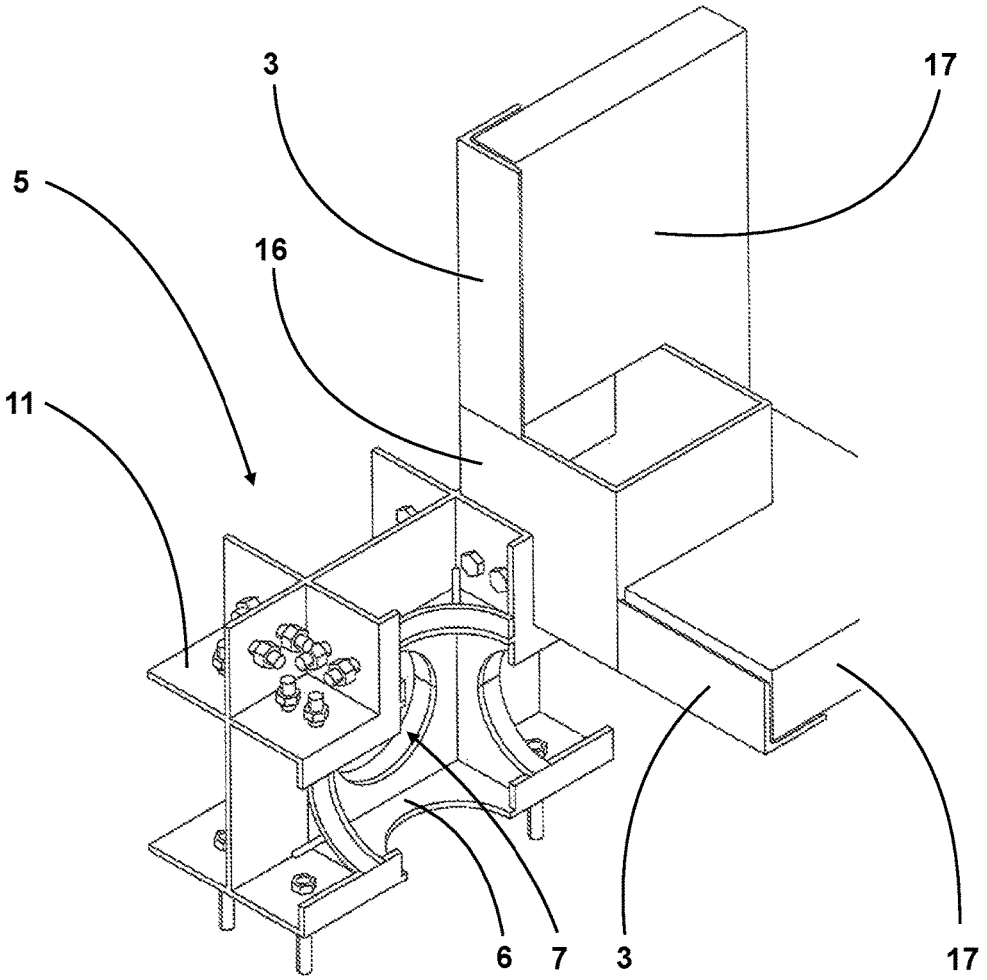

By referring to FIG. 4, at an edge of the core 6 two supporting plates 9 extend one beyond the other one and viceversa, by forming a side rest 12 formed by two L-like positioned plate ends.

It is to be noted that, at each rest formed thereby, the supporting plates 9 comprise a plurality of through holes apt to be engaged by respective boltings 14 for fastening with the module frames 10.

Figure 6:
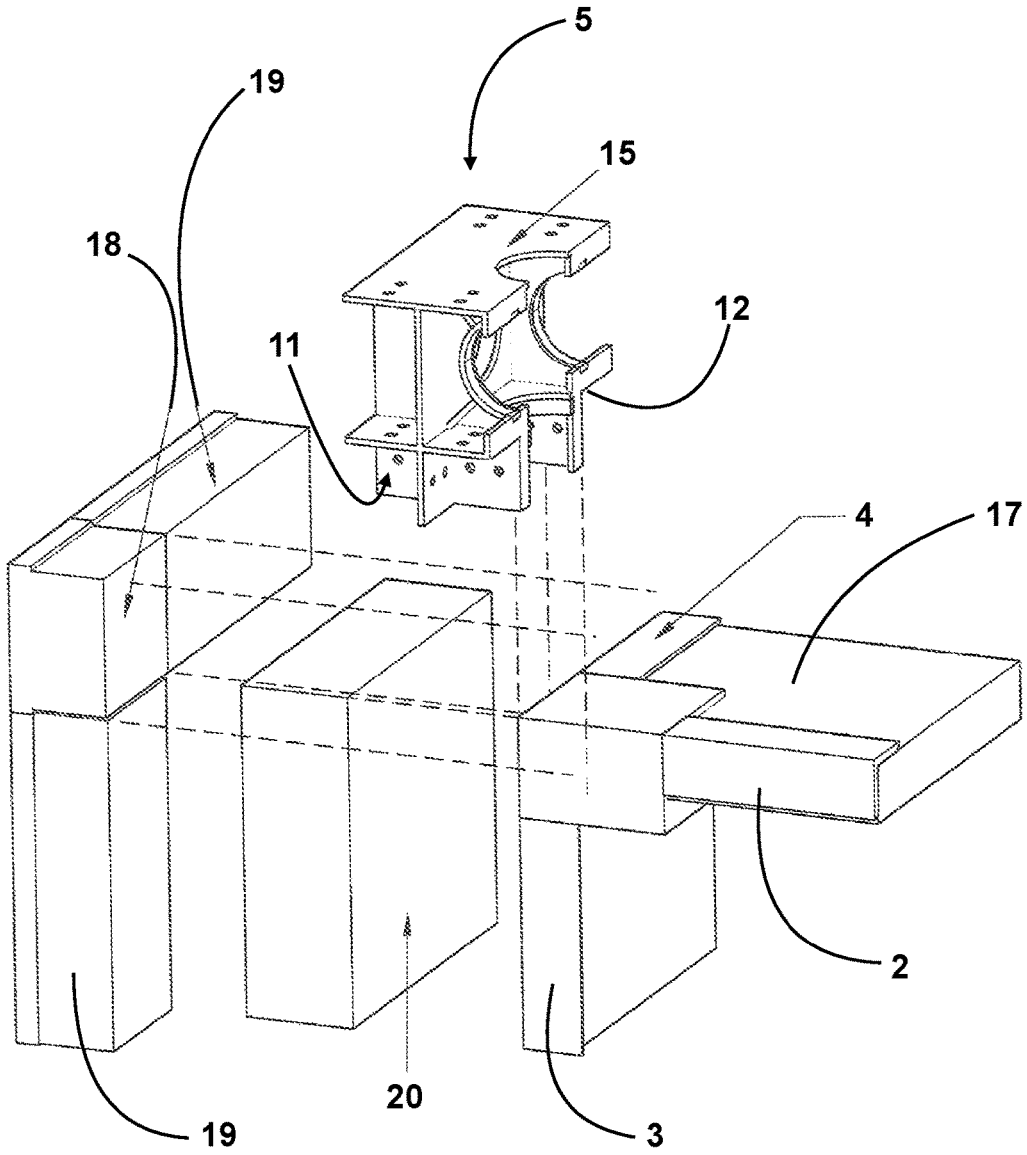

In case a supporting plate 9 is not crossed by any of the adjacent plates, it forms a resting plane 15 which can be connected to a basement or a roof (FIG. 6).

The shape of the knots 5 then allows not only to connect adjacent module frames 10, but to space apart them one from the other one. This determines two substantially combined effects:

1. the overall sizes of the complex frame obtained by assembling module frames will be larger than the sum of the sizes of the single module frames; and
2. the distance between each module frame could allow, together with the presence of the above-mentioned channels in each knot 5, to arrange easily through plants of electric, water nature (mains water, which water, waste water, heating, refrigeration), air conditioning plants, service tubes, alarm plants and so on.

The first one of said effects allows to make each preassembled module 50 capable of being transported in a simple way, as a usual container, and then to obtain a building the overall sizes thereof would not be otherwise compatible with normal transportation systems.

To this regard, the previously described angular rests will be useful to receive the angles of each module frame 10. Each angle will include a connecting element 16 of box-like type, formed by two or three walls connected therebetween, which will be in contact with the respective rest. The connecting elements 16 will be useful to join therebetween the beams 2, 3, 4 of the frame module 10.

Advantageously, these beams have a L-like section with the inner angle facing towards the inner space of the module frame 10. In this way, they could be useful to receive the edges of panels 17 which will form the floors or partitions inside the assembled building, or connecting elements between adjacent panels.

The L-like beams, as well as the connecting elements 16, could be made of suitable material, for example a folded or forged steel plate, or obtained by welding.

The above-described structure obtained by assembling the knots 5 with the module frames 10 further allows to obtain an adequate resistance to earthquake motions according to the existing rules.

Each module frame 10 could include elements for reinforcing the structure thereof. In particular, the section of the beams 2, 3, 4 could be of box-like type; the beams could be connected by vertical struts arranged on the vertical faces, or angular brace assemblies or additional diagonal beams, or even transversal currents on any face.

It is to be noted that each module 50, although formed by a frame which repeats from module to module, could assume very different shapes. In particular, it could include outer claddings which could be adapted to the climatic area of interest, or inner partitions, or even windows with wide sizes or walls with pre-assembled windows, or at last empty spaces for creating unique environments extending on several modules.

Advantageously, the longitudinal sizes of the frame module could be equal to the sum of a finite number N of cross sizes of N−1 knots: typically the longitudinal size could be equal to that of two module frames arranged transversally plus an intermediate knot This allows to assemble different module frames by changing the orientation thereof within the same complex frame, thus by obtaining an even greater freedom in assembling the different modules.

Furthermore, they could be arranged to obtain terraces, or wide inner spaces surrounded by modules and so on, by using the modules as if they were bricks to create any shape.

At the outer surface of the complex frame 1, the rests prearranged by the knots 5 could receive respective stopper-like elements 18, for closing the opening 7 facing outwards, and framework elements 19 extending from a knot to the other one and which will be useful to support a cladding panel 20.

In this way, on the same outer wall, each so-obtained framework could provide a different cladding, so as to obtain different compositions.

It is to be noted that the above-mentioned stopper-like elements and the framework elements have the task, together with the panels 20, to close the outer surfaces of the building, but even to implement a seal preventing the air from entering the intermediate spaces between the module frames 10, acting as thermal and acoustic insulation and even for fireproofing purposes.

Such seal can be implemented thanks to self-expanding belts and gaskets, arranged on the edges of the stopper-like elements and of the framework elements.

The above-described components will be treated to have fireproofing, anti-intumescent features and to be protected from corrosion.

To the above-described a person skilled in the art, in order to satisfy additional and contingent needs, could introduce several additional modifications and variants, all however comprised within the protection scope of the present invention, as defined by the enclosed claims.

The invention claimed is:

1. A modular building structure having a complex frame, obtained by assembling a plurality of module frames, and comprising walls and floors implemented by cladding panels, wherein the module frames have a substantially parallelepiped-like shape and are identified by longitudinal, vertical and transversal beams which join at respective angles, comprising a plurality of connecting knots joining adjacent module frames at said angles, and provided to connect the module frames either to a flat basement or to a roof structure, wherein each connecting knot has a box-like structure with a hollow parallelepipedal inner core having six walls facing two by two and identifying planes orthogonal to each other, each wall having an opening so that the openings form together three orthogonal channels intersecting at the inner core, and wherein, at each opening, the knot comprises corresponding supporting plates, each lying on the respective plane, and extending beyond the planes identified by at least one or more walls, thereby defining a respective corner or side rest.

2. The modular building structure according to claim 1, wherein the module frames have a straight parallelepiped shape with rectangular faces, and with sizes complying with container standard sizes.

3. The modular building structure according to claim 1, wherein said inner core is cubic.

4. The modular building structure according to claim 1, wherein said opening is circular.

5. The modular building structure according to claim 1, wherein said inner core is constructed in one single piece.

6. The modular building structure according to claim 1, wherein, at corners of the inner core, said supporting plates form a corner rest formed by three supporting plates forming an angular space with three resting walls.

7. The modular building structure according to claim 1, wherein, at edges of the inner core a pair of supporting plates form an L-like shaped side rest.

8. The modular building structure according to claim 1, wherein, at each either corner or side rest, the supporting plates comprise a plurality of through holes configured to be engaged by respective bolts for fastening them with the module frames.

9. The modular building structure according to claim 1, wherein connecting knots at either a flat basement or a roof structure form a resting plane.

10. The modular building structure according to claim 1, wherein said longitudinal, vertical, and transversal beams have a L-like section with the inner angle facing towards an inner space of the respective module frame.

11. The modular building structure according to claim 10, wherein said side rests comprise a respective box-like type connecting element, formed by two or three walls connected therebetween, in contact with the walls of the side rest.

12. The modular building structure according to claim 1, wherein each module frame has a module longitudinal size and a respective module cross size, and each connecting knot has a knot cross size, the module longitudinal size matching the sum of a finite number N of module cross sizes plus the knot cross sizes of N−1 connecting knots, and wherein a single module longitudinal size is equal to that of two module frames arranged transversally plus an intermediate knot.

13. The modular building structure according to claim 1, wherein at an outer surface of said complex frame, said corner and side rests receive:

respective stopper-like elements closing the inner core opening facing outwards, and framework elements, extending from one knot to another knot, supporting a module frame cladding panel.

* * * * *